US011454179B2

(12) United States Patent
Schroeder et al.

(10) Patent No.: US 11,454,179 B2
(45) Date of Patent: Sep. 27, 2022

(54) ENGINE BRAKE CONTROL ACCORDING TO ENGINE OPERATING PARAMETERS

(71) Applicant: Caterpillar Inc., Peoria, IL (US)

(72) Inventors: Eric Lee Schroeder, Germantown Hills, IL (US); David Andrew Pierpont, Dunlap, IL (US); Zach Engstrom, East Peoria, IL (US); Shivangi Wagle, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 130 days.

(21) Appl. No.: 16/990,075

(22) Filed: Aug. 11, 2020

(65) Prior Publication Data

US 2022/0049661 A1 Feb. 17, 2022

(51) Int. Cl.

| | |
|---|---|
| ***F02D 13/04*** | (2006.01) |
| ***F02D 41/02*** | (2006.01) |
| ***F02D 41/38*** | (2006.01) |

(52) U.S. Cl.

CPC ..... *F02D 13/04* (2013.01); *F02D 41/024* (2013.01); *F02D 41/38* (2013.01); *F02D 2200/0406* (2013.01); *F02D 2200/501* (2013.01)

(58) Field of Classification Search

CPC ..... F02D 13/04; F02D 41/024; F02D 41/38; F02D 2200/0406; F02D 2200/501

See application file for complete search history.

(56) References Cited

U.S. PATENT DOCUMENTS

| | | | | |
|---|---|---|---|---|
| 5,271,229 | A | 12/1993 | Clarke et al. | |
| 6,354,266 | B1 | 3/2002 | Cornell et al. | |
| 2003/0200744 | A1* | 10/2003 | Sutton | F01L 13/065 60/306 |
| 2004/0172935 | A1 | 9/2004 | Otake et al. | |
| 2008/0196388 | A1* | 8/2008 | Johnson | F02D 13/04 60/284 |
| 2008/0210197 | A1* | 9/2008 | Smith | F02D 9/06 123/321 |
| 2015/0000630 | A1 | 1/2015 | Coldren | |
| 2020/0011257 | A1* | 1/2020 | Stretch | F02D 41/0087 |

FOREIGN PATENT DOCUMENTS

| | | | |
|---|---|---|---|
| DE | 10348107 | A1 | 5/2005 |
| EP | 3346116 | A1 | 7/2018 |
| WO | 2017127219 | A1 | 7/2017 |

* cited by examiner

*Primary Examiner* — Audrey B. Walter
*Assistant Examiner* — Dapinder Singh
(74) *Attorney, Agent, or Firm* — Harrity & Harrity, LLP

(57) ABSTRACT

An engine brake controller may obtain a performance characteristic of an engine. The engine brake controller may determine, based on the performance characteristic of the engine, that engine braking is enabled to control the engine. The engine brake controller may monitor a set of operating parameters of the engine. The engine brake controller may determine that operating values of the set of operating parameters satisfy corresponding thresholds of the set of operating parameters. The engine brake controller may determine, based on the operating values satisfying the corresponding thresholds, an engine braking configuration associated with activating engine braking of a set of cylinders of the engine. The set of cylinders may be a proper subset of a total quantity of cylinders of the engine. The engine brake controller may cause the engine braking to be applied to the set of cylinders to increase a temperature of exhaust gas from the engine.

20 Claims, 3 Drawing Sheets

ENGINE BRAKE CONTROL ACCORDING TO ENGINE OPERATING PARAMETERS

TECHNICAL FIELD

The present disclosure relates generally to engine brake control and, for example, to engine brake control according to engine operating parameters.

BACKGROUND

A power system (e.g., a 4-stroke engine) powers a vehicle by converting chemical energy stored in fuel (e.g., diesel fuel, gasoline, and/or the like) into mechanical work. In a diesel-powered engine, the fuel is injected directly into a cylinder from a fuel injector to form an air-fuel mixture. A piston, movably mounted within the cylinder to travel in a cycle between a top dead center (TDC) position and a bottom dead center (BDC) position, compresses the air-fuel mixture, which causes an explosion. A force of the explosion drives the piston down towards the BDC position, and the cycle repeats. Because the piston is connected to a drive train of the vehicle, continued movement of the piston propels the vehicle. To increase fuel efficiency and/or power output, the power system may include one or more turbochargers. The one or more turbochargers, which are driven by exhaust gases from the engine, compress and send air back to the engine for further combustion.

While the power system has a number of benefits, including greater fuel efficiency compared to a gasoline-powered system, performance of the power system may suffer in certain conditions. For example, when the power system is in a low-load state, the power system may experience poor transient response and/or sub-standard emissions. Transient response of the power system occurs during changes in engine speed or load (e.g., acceleration, load increase, and/or the like). Due to turbocharger lag in responding to the changes, a ratio of the air-fuel mixture may temporarily decrease, leading to slow engine response. Furthermore, because of low temperatures of the exhaust gases during the low-load state, the power system may experience an increase in particulate matter and/or gaseous emissions (e.g., nitrogen oxides, carbon monoxide, hydrocarbons, and/or the like).

One attempt to improve emissions during a low-load state is disclosed in U.S. Publication No. 2008/0196388 ("the '388 publication"). In particular, the '388 publication discloses an apparatus for activating a diesel particulate filter by use of an internal combustion engine. The apparatus includes an engine brake under the control of a controller and one or more sensors sensing information associated with operation of the engine. During operation of the engine, untreated exhaust gas flows through the diesel particulate filter which removes emissions from the exhaust gas. The treated exhaust gas may subsequently be released into the atmosphere. From time to time during operation of the engine, the controller selectively operates the engine brake on one or more of the engine cylinders while increasing the load on at least one cylinder allowed to combust fuel to generate sufficient engine heat to regenerate or otherwise activate the diesel particulate filter.

The power system of the present disclosure is directed to overcoming one or more of the problems set forth above and/or other problems in the art.

SUMMARY

According to some implementations, a method may comprise: obtaining a performance characteristic of an engine; determining, based on the performance characteristic of the engine, that engine braking is enable to control the engine; identifying, based on the performance characteristic, a set of operating parameters of the engine that are associated with the performance characteristic; monitoring the set of operating parameters to obtain operating values; determining that the operating values satisfying corresponding thresholds of the set of operating parameters; determining, based on the operating values satisfying the corresponding thresholds, an engine braking configuration associated with activating engine braking of a set of cylinders of the engine to increase the temperature of exhaust gas from the engine, wherein the set of cylinders is a proper subset of a total quantity of cylinders of the engine; and causing the engine braking to be applied to the set of cylinders to increase the temperature of exhaust gas from the engine.

According to some implementations, a control system may comprise: a plurality of sensors; and a controller communicatively coupled to the plurality of sensors to: determine that engine braking is enabled to control the engine; identify, based on the engine braking being abled, a set of operating parameters of the engine that are associated with the performance characteristic; monitor, via the plurality of sensors, the set of operating parameters that are associated with applying engine braking to the engine; determine, based on the operating values satisfying the corresponding thresholds, an engine braking configuration associated with activating engine braking of a set of cylinders of the engine; and cause the engine braking to be applied to the set of cylinders to increase the temperature of exhaust gas from the engine.

According to some implementations, a power system may comprise: an engine that includes a plurality of cylinders; a plurality of sensors; and a controller configured to: determine, based on a performance characteristic of the engine, that engine braking is enabled to control the engine; identify, based on the engine braking being enabled, a set of operating parameters of the engine that are associated with the performance characteristic; monitor, via the plurality of sensors, the set of operating parameters; determine that operating values of the set of operating parameters satisfy corresponding thresholds of the set of operating parameters; determine, based on the operating values, an engine braking configuration associated with activating engine braking of a set of cylinders of the plurality of cylinders; and cause the engine braking to be applied to the set of cylinders to cause an increase of an amount of fuel to be provided to one or more other cylinders that are not included in the set of cylinders.

DETAILED DESCRIPTION

This disclosure relates to an engine brake controller that controls an exhaust valve of a power system and a fuel injector that is associated with the exhaust valve. The engine brake controller, as described herein, has universal applicability to any machine utilizing such a power system with a turbocharged engine. The term "machine" may refer to a machine that performs an operation associated with an industry such as, for example, transportation, mining, construction, farming, and/or the like. As some examples, the machine may be a motor vehicle, a railed vehicle, a watercraft, an aircraft, a backhoe loader, a cold planer, a wheel loader, a compactor, a feller buncher, a forest machine, a forwarder, a harvester, an excavator, an industrial loader, a knuckleboom loader, a material handler, a motor grader, a pipelayer, a road reclaimer, a skid steer loader, a skidder, a telehandler, a tractor, a dozer, a tractor scraper, or other above ground equipment, underground equipment, or marine equipment.

Figure 1:
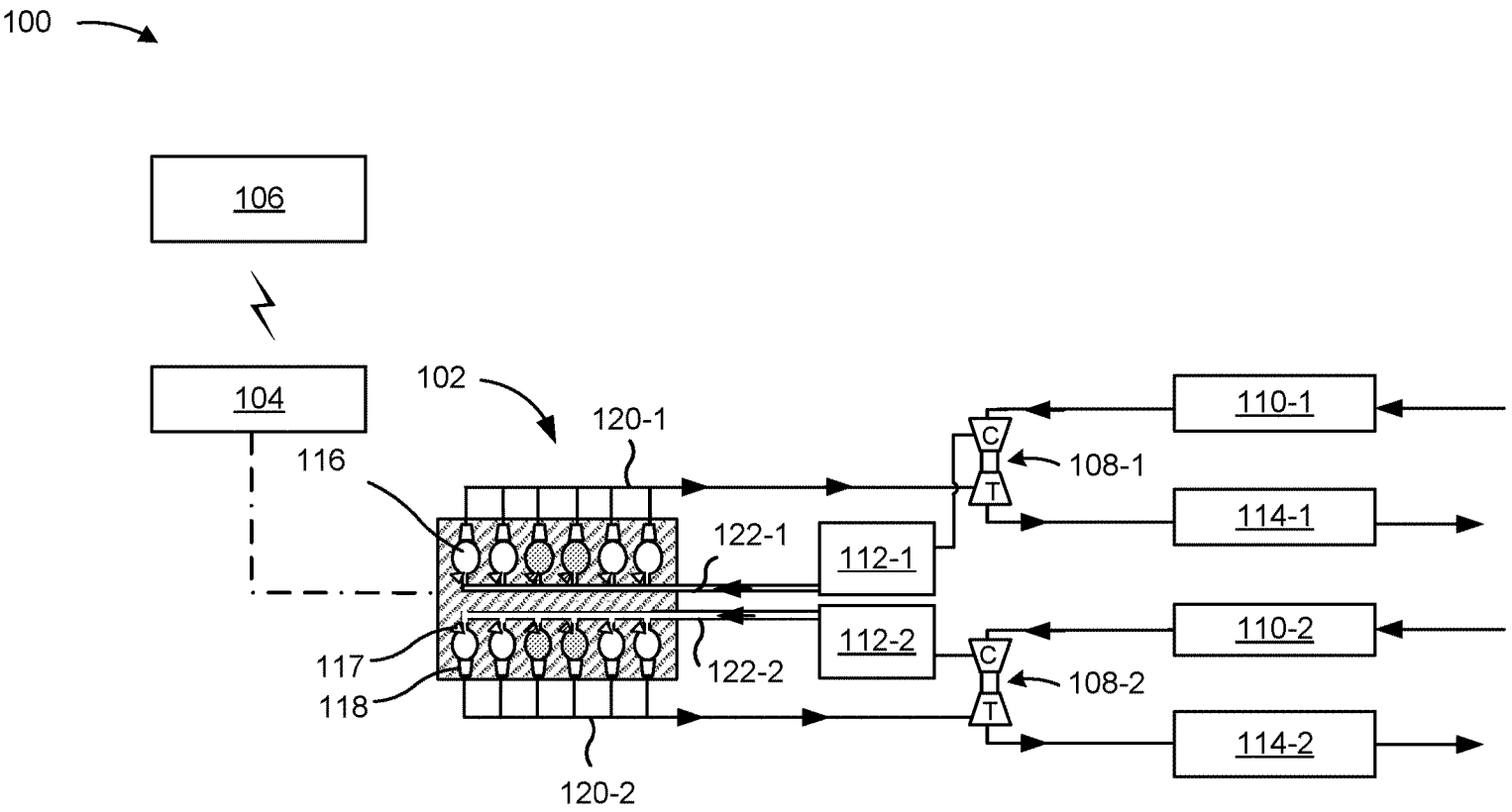
FIG. 1 is a diagram of an example power system described herein.

FIG. 1 is a diagram of an example power system 100 described herein. The power system 100 includes an engine 102 (e.g., a 4-stroke, diesel-powered engine, and/or the like), an electronic control module (ECM) 104, one or more sensors 106, turbochargers 108-1, 108-2 (e.g., sequential turbochargers, and/or the like), intake devices 110-1, 110-2, aftercoolers 112-1, 112-2 (e.g., air-to-air aftercoolers (ATAACs), and/or the like), and aftertreatment devices 114-1, 114-2 (e.g., selective catalytic reduction (SCR) components, and/or the like). The type, quantity, and/or arrangement of components of the power system 100 are provided as an example. In practice, the power system 100 may have one or more different types of components, a different quantity of components, and/or a different arrangement of components based on a context in which the power system 100 is used.

The engine 102 includes a plurality of cylinders 116 (e.g., 6 cylinders, 8 cylinders, 12 cylinders, and/or the like), a plurality of fuel injectors 117, and a plurality of engine brake mechanisms 118 (e.g., compression brake mechanisms, and/or the like). The plurality of fuel injectors 117 and the plurality of engine brake mechanisms 118 may be associated with some or all of the plurality of cylinders 116. The plurality of cylinders 116 each includes a respective piston movably mounted therein to travel in a 4-stroke cycle (including an intake stroke, a compression stroke, a combustion stroke, and an exhaust stroke) between a top dead center (TDC) position and a bottom dead center (BDC) position to drive a drivetrain. The plurality of cylinders 116 may be arranged in an in-line configuration, a "V" configuration, or another suitable configuration.

The plurality of fuel injectors 117 and the plurality of engine brake mechanisms 118 are controlled by the ECM 104 based on communication from the one or more sensors 106. The ECM 104 is configured to turn off a proper subset of the plurality of fuel injectors 117 and activate (e.g., apply) a proper subset of engine brake mechanisms 118 when the ECM 104 determines that the engine 102 is in a low-load state and is therefore susceptible to issues with transient response and/or hydrocarbon buildup. The ECM 104 may determine that the engine 102 is in the low-load state by calculating a load of the engine 102 (e.g., based on an engine speed, based on a fuel rate, and/or the like) and comparing the load with a low-load threshold (e.g., 10% of a maximum load of the engine 102, 15% of the maximum load of the engine 102, and/or the like). The ECM 104 may be configured to turn on and/or turn off individual fuel injectors of the plurality of fuel injectors 117, a subset of fuel injectors of the plurality of fuel injectors 117 (e.g., a subset of four fuel injectors (as indicated by shading in FIG. 1), a subset of eight fuel injectors 117, and/or the like), or an entirety of the plurality of fuel injectors 117. Likewise, the ECM 104 may be configured to activate and/or deactivate individual engine brake mechanisms of the plurality of engine brake mechanisms 118, a subset of engine brake mechanisms of the plurality of engine brake mechanisms 118 (e.g., a subset of four engine brake mechanisms (as indicated by shading in FIG. 1), a subset of eight engine brake mechanisms, and/or the like), or an entirety of the plurality of engine brake mechanisms 118.

For explanation purposes, a functionality of a single engine brake mechanism (e.g., of the plurality of engine brake mechanisms 118), a single associated fuel injector 117 (e.g., of the plurality of fuel injectors 117), a single associated cylinder (e.g., of the plurality of cylinders 116), the turbocharger 108-1, the intake device 110-1, the aftercooler 112-1, the aftertreatment device 114-1, the exhaust manifold 120-1, and the intake manifold 122-1 will be described. It should be understood that this functionality is applicable to all of the plurality of engine brake mechanisms 118, the plurality of fuel injectors 117, the plurality of cylinders 116, the turbocharger 108-2, the intake device 110-2, the aftercooler 112-2, the aftertreatment device 114-2, the exhaust manifold 120-2, and the intake manifold 122-2.

While activating an engine brake mechanism 118 (e.g., based on a performance characteristic and/or one or more operating parameters, which will be described in more detail below), the ECM 104 prevents fuel from being injected into a cylinder 116 associated with the engine brake mechanism 118. To do so, the ECM 104 communicates with a fuel injector 117 associated with the cylinder 116 to turn off the fuel injector 117. Once activated by the ECM 104, the engine brake mechanism 118 is configured to open an exhaust valve associated with the cylinder 116 when the piston is approaching the TDC position during the compression stroke. By doing so, the engine brake mechanism 118 releases compressed air from the cylinder 116 before the compressed air combusts. Thus, rather than combusting within the cylinder 116 and driving the piston down towards the BDC position, according to a normal 4-stroke cycle, the compressed air is released through the exhaust valve into the exhaust manifold 120-1 of the engine 102. Having lost energy stored in the compressed air and without the combustion of fuel in the cylinder 116, the engine 102 must expend energy to pull the piston back down and continue the cycle at a desired speed (e.g., 1800 revolutions per minute (rpm), 2400 rpm, and/or the like). To do so, other cylinders of the plurality of cylinders 116, which continue to function according to the normal 4-stroke cycle, compensate by consuming additional fuel (e.g., via a subset of the plurality of fuel injectors 117) and, as a result, expel exhaust gas of increased temperature.

The exhaust gas, once expelled from the other cylinders of the plurality of cylinders 116, travels along a passageway to drive a turbine ("T") of the turbocharger 108-1. Due to the increased temperature of the exhaust gas, the turbine rotates at a higher speed. The turbine is connected by a shaft to a compressor ("C"), which rotates at the same speed as the turbine to draw in and compress air from the intake device 110-1. The air, once compressed, passes through the aftercooler 112-1 and through the intake manifold 122-1 to the plurality of cylinders 116. Because of the higher speed of rotation, the turbocharger 108-1 supplies the engine 102 with a power boost.

The exhaust gas, after passing through the turbine of the turbocharger 108-1, travels along an exhaust conduit to the aftertreatment device 114-1. The aftertreatment device 114-1 is configured to trap and/or convert particular constituents before expelling the exhaust gas from the power system 100. In one example, the aftertreatment device 114-1 may include an SCR component having a catalyst substrate located downstream from a reductant injector. A gaseous or liquid reductant (e.g., urea or a water and urea mixture) may be sprayed or otherwise advanced into the exhaust gas by a reductant injector. As the reductant is absorbed onto a surface of the catalyst substrate, the reductant may react with nitrogen oxides (NOx) in the exhaust gas to form water ($H_2O$) and elemental nitrogen ($N_2$). The increased temperature of the exhaust gas may help to eliminate and/or prevent buildup of unburnt hydrocarbons in the catalyst substrate. Thus, the aftertreatment device 114-1, in combination with the increased temperature of the exhaust gas, may improve emissions produced by the power system 100.

When the ECM 104 determines that the engine 102 is no longer in the low-load state (e.g., due to an increase of the load above the low-load threshold), the ECM 104 is configured to quickly (e.g., within a few milliseconds (ms), a few second(s), and/or the like) deactivate the engine brake mechanism 118 and turn on the fuel injector 117 to resume the normal 4-stroke cycle of the cylinder 116. Because the ECM 104 is able to respond more quickly to changes in load than the turbocharger 108-1, the ECM 104 reduces transient response time and, as a result, improves performance of the engine 102 by maintaining a substantially constant engine speed.

As indicated above, FIG. 1 is provided as an example. Other examples are possible and may differ from what was described in connection with FIG. 1. The number and arrangement of components and/or devices shown in FIG. 1 is provided as an example. In practice, there may be additional components and/or devices, fewer components and/or devices, different components and/or devices, or differently arranged components and/or devices than those shown in FIG. 1. Furthermore, two or more components and/or devices shown in FIG. 1 may be implemented within a single component and/or device, or a single component and/or device shown in FIG. 1 may be implemented as multiple components and/or devices. Additionally, or alternatively, a set of components and/or devices (e.g., one or more components and/or devices) of FIG. 1 may perform one or more functions described as being performed by another set of components and/or devices of FIG. 1.

Figure 2:
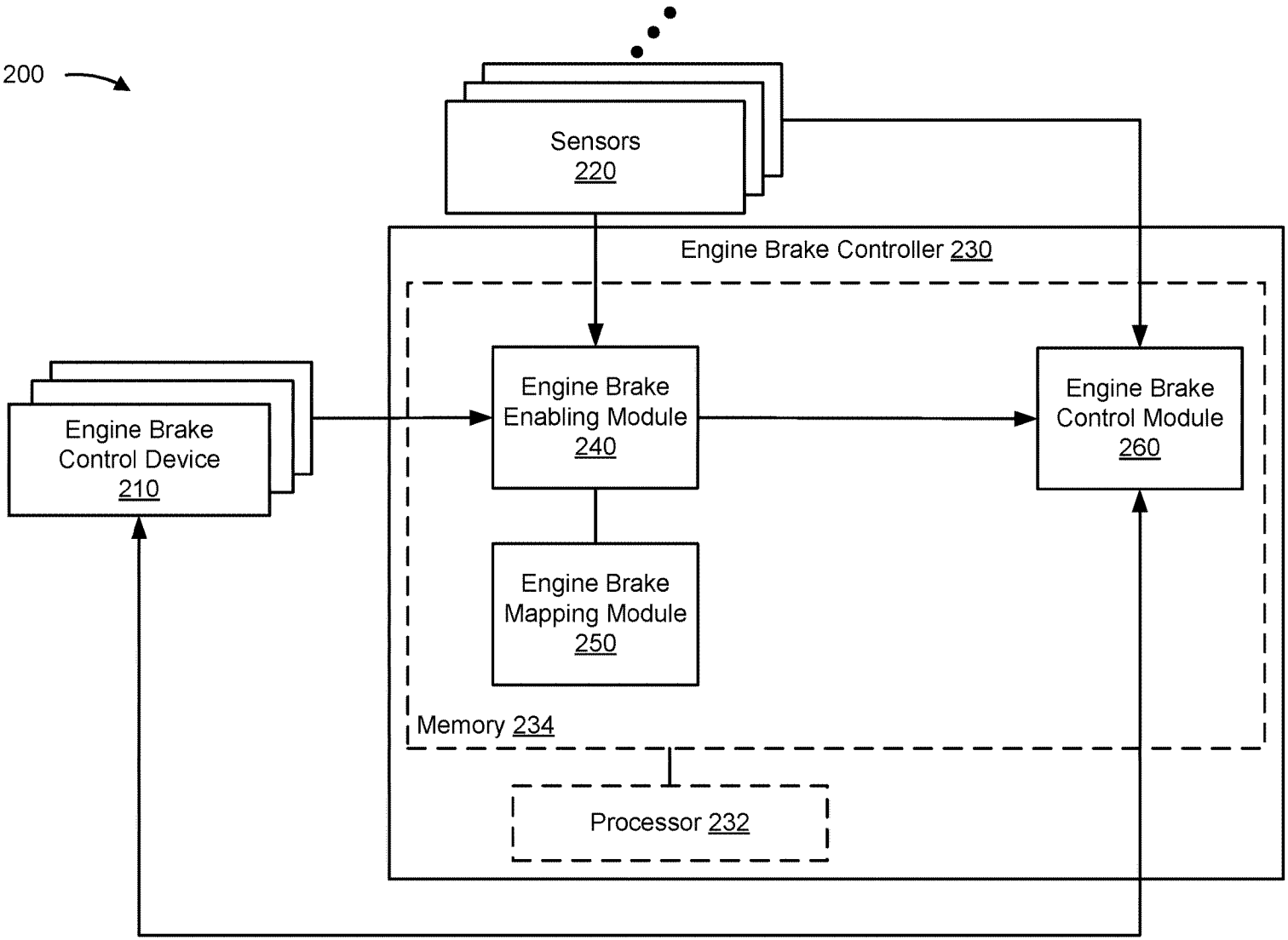
FIG. 2 is a diagram of an example control system that may be included within the power system of FIG. 1, as described herein.

FIG. 2 is a diagram of an example engine brake control system 200 that may be included within the power system 100 of FIG. 1, as described herein. As shown in FIG. 2, the engine brake control system 200 includes one or more engine brake control devices 210, one or more sensors 220, and an engine brake controller 230.

The one or more engine brake control devices 210 include one or more components and/or devices that may be used by the engine brake controller 230 to control exhaust valves of the engine 102. For example, the one or more engine brake control devices 210 may include one or more actuators, switches, integrated circuits (ICs), and/or the like that are capable of opening and/or closing exhaust valves fluidly coupled (e.g., via one or more recirculation lines) with the exhaust manifold 120-1 and/or the exhaust manifold 120-2. The one or more engine brake control devices 210 may include, or correspond to, the engine brake mechanisms 118 of FIG. 1.

An engine brake control device 210, of the one or more engine brake control devices 210, may be a binary valve that has an open position (e.g., a position that enables exhaust gas to flow to the turbocharger 108-1 and/or the turbocharger 108-2) and a closed position (e.g., a position that prevents the exhaust gas from flowing to the turbocharger 108-1 and/or the turbocharger 108-2). In some implementations, the engine brake control device 210 may include a variable position valve that may be set to variable positions between the open position and the closed position (e.g., positions that allow some, but not all, of the exhaust gas to flow to the turbocharger 108-1 and/or the turbocharger 108-2).

The one or more sensors 220 include one or more types of sensors configured to measure operating parameters of the power system 100 (e.g., to determine operating values corresponding to the operating parameters). For example, the one or more sensors 220 may include one or more temperature sensors, one or more position sensors, one or more speed sensors, one or more pressure sensors, one or more fuel sensors, one or more time sensors, one or more content sensors, a combination of the foregoing types of sensors, and/or the like. The one or more sensors 220 may include, or correspond to, the one or more sensors 106 of FIG. 1.

A temperature sensor, of the one or more temperature sensors, may be configured to detect temperature of air, exhaust gas, a component, coolant, and/or the like. A position sensor, of the one or more position sensors, may be configured to detect a position of a valve, an actuator, an engine part (e.g., a piston), and/or the like. A speed sensor, of the one or more speed sensors, may be configured to detect an engine speed, a turbocharger speed, a machine speed, and/or the like. A pressure sensor, of the one or more pressure sensors, may be configured to detect a measure of compression of air or exhaust gas in the power system 100. A fuel sensor, of the one or more fuel sensors, may be configured to detect an amount of fuel and/or a flow rate of the fuel in a line prior to reaching a fuel pump. A time sensor, of the one or more time sensors, may be configured to detect an amount of engine run time, an amount of engine brake time, and/or the like. A content sensor, of the one or more content sensors, may be configured to detect emission levels of power system 100, such as an amount of NOx, an amount of carbon monoxide, an amount of hydrocarbon, an amount of particulate matter, an amount of soot, and/or the like. The speed sensor and/or the fuel sensor may be load indicators.

The engine brake controller 230 includes a processor 232, a memory 234, an engine brake enabling module 240, an engine brake mapping module 250, and an engine brake control module 260. The processor 232 is implemented in hardware, firmware, and/or a combination of hardware and software. The processor 232 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. The processor 232 includes one or more processors capable of being programmed to perform a function. The memory 234 includes a random-access memory (RAM), a read only memory (ROM), and/or another type of dynamic or static storage device (e.g., a flash memory, a magnetic memory, and/or an optical memory) that stores information and/or instructions for use by the processor 232 (e.g., information and/or instructions associated with the engine brake enabling module 240, the engine brake mapping module 250, the engine brake control module 260, and/or the like). The engine brake controller 230 may include, or correspond to, the ECM 104 of FIG. 1.

The engine brake enabling module 240 may be implemented in hardware, firmware, or a combination of hardware and software. The engine brake enabling module 240 is configured to control the one or more engine brake control devices 210 to enable engine braking, and as a result, selectively enable the one or more engine brake control devices 210. The engine brake enabling module 240 may determine whether to enable the one or more engine brake control devices 210 based on a performance characteristic. The performance characteristic may be associated with prioritizing a reduction to a transient response time of an output of the engine 102, prioritizing a reduction of a hydrocarbon buildup in one or more exhaust aftertreatment devices (e.g., the aftertreatment device 114-1 and/or the aftertreatment device 114-2), and/or the like. To obtain the performance characteristic, the engine brake enabling module 240 may receive, via an operator interface associated with the engine 102, an operator input that identifies the performance characteristic. For example, an operator may interact with the operator interface to instruct the engine brake enabling module 240 to prioritize the reduction of the transient response time, the reduction of the hydrocarbon buildup, and/or the like. In some implementations, the engine brake enabling module 240 may obtain the performance characteristic from another module or device, which provides a default setting of the performance characteristic.

Alternatively, or additionally, the engine brake enabling module 240 may enable the one or more engine brake control devices 210 based on a load of the engine 102 satisfying a low-load threshold (e.g., 10% of a maximum load of the engine 102, 15% of the maximum load of the engine 102, and/or the like). To determine that the load of the engine 102 satisfies the low-load threshold, the engine brake enabling module 240 may monitor at least one of the one or more sensors 220 (e.g., by comparing an operating value of a sensor with a corresponding threshold, and/or the like). For example, the engine brake enabling module 240 may monitor the one or more fuel sensors of the one or more sensors 220 by comparing an amount of fuel and/or a flow rate of the fuel with a corresponding threshold. The engine brake enabling module 240 may correlate a particular amount of fuel and/or a particular flow rate with the low-load threshold to determine that the engine 102 is in a low-load state. Additionally, or alternatively, the engine brake enabling module 240 may monitor the one or more speed sensors of the one or more sensors 220 by comparing an engine speed with corresponding one or more thresholds. The engine brake enabling module 240 may correlate a particular engine speed with the low-load threshold to determine that the engine 102 is in the low-load state.

The engine brake enabling module 240 may communicate the performance characteristic to the engine brake mapping module 250 to determine which of the one or more engine brake control devices 210 to enable. Based on data received from the engine brake mapping module 250 (as described below), the engine brake enabling module 240 may send control signals to the one or more engine brake control devices 210 to enable the one or more engine brake control devices 210 individually, a subset of the one or more engine brake control devices 210, or all of the one or more engine brake control devices 210. By enabling the one or more engine brake control devices 210, the engine brake enabling module 240 may configure the one or more engine brake control devices 210 for later activation and/or deactivation. In some implementations, the engine brake enabling module 240 may consider historical data relating to prior use of the one or more engine brake control devices 210 and enable different ones of the engine brake control devices 210. By doing so, the engine brake enabling module 240 may avoid repeated use of the same ones of the one or more engine brake control devices 210, and as a result, extend a useful life of the one or more engine brake control devices 210 and the engine 102.

The engine brake mapping module 250 may be implemented in hardware, firmware, or a combination of hardware and software. The engine brake mapping module 250 is configured to map operating values obtained from the one or more sensors 220 to respective amounts of engine braking and/or store data relating to use of the one or more engine brake control devices 210. Based on the performance characteristic, the engine brake mapping module 250 may identify a set of operating parameters of the engine 102. The set of operating parameters may be associated with applying engine braking to the engine 102 and may differ based on the performance characteristic. For example, when the performance characteristic is associated with prioritizing a reduction in transient response time, the set of operating parameters may include an engine run time of the engine 102, an amount of fuel in a line of the engine 102, a flow rate of the fuel in the line of the engine 102, an intake manifold pressure of an intake of the engine 102, an engine speed of an output of the engine 102, a coolant temperature of the engine 102, and/or the like. In another example, when the performance characteristic is associated with prioritizing a reduction in hydrocarbon buildup, the set of operating parameters may include an amount of fuel in a line of the engine 102, a flow rate of the fuel in the line of the engine 102, an engine speed of an output of the engine 102, an amount of hydrocarbon buildup in an exhaust aftertreatment device (e.g., the aftertreatment device 114-1 and/or the aftertreatment device 114-2), an air-to-fuel ratio of a turbocharger (e.g., the turbocharger 108-1 and/or the turbocharger 108-2) of the engine 102, and/or the like.

The engine brake mapping module 250 may monitor the set of operating parameters of the engine 102. To do so, the engine brake mapping module 250 may identify a set of sensors (e.g., of the one or more sensors 220) that are associated with the set of operating parameters and obtain the operating values from the set of sensors. After obtaining the operating values, the engine brake mapping module 250 may determine that the operating values satisfy corresponding thresholds of the set of operating parameters (e.g., a threshold engine run-time, a threshold intake manifold pressure, a threshold coolant temperature, a threshold amount of fuel, a threshold engine speed, a threshold amount of hydrocarbon buildup, a threshold air-to-fuel ratio, and/or the like). Based on the operating values satisfying the corresponding thresholds, the engine brake mapping module 250 may determine an engine braking configuration. The engine braking configuration may be associated with activating engine braking of a set of cylinders (e.g., four cylinders, six cylinders, eight cylinders, and/or the like) to increase the temperature of exhaust gas from the engine. The set of cylinders may be a proper subset of a total quantity of cylinders of the engine 102.

In some implementations, when determining the engine braking configuration, the engine brake mapping module 250 may determine, based on the operating values, a level of engine braking that is to be applied to the engine 102, determine, based on the level of engine braking, a quantity of cylinders that are to receive engine braking, and select the set of cylinders to include the quantity of cylinders. For example, the engine brake mapping module 250 may determine that an amount of hydrocarbon buildup, as measured by the one or more content sensors, may call for a low level of engine braking (e.g., engine braking of four cylinders), a medium level of engine braking (e.g., engine braking of six cylinders), a high level of engine braking (e.g., engine braking of eight cylinders), and/or the like, to sufficiently reduce the amount of hydrocarbon buildup. After determining the engine braking configuration, the engine brake mapping module 250 may store data relating to the engine braking configuration and/or communicate the engine braking configuration to the engine brake control module 260.

The engine brake control module 260 may be implemented in hardware, firmware, or a combination of hardware and software. The engine brake control module 260 is configured to control the one or more engine brake control devices 210 to activate (e.g., apply) and/or deactivate (e.g., release) engine braking. For example, in accordance with the engine braking configuration, the engine brake control module 260 may be configured to send a control signal (e.g., a command, instructions, and/or the like) to one or more exhaust valves associated with the one or more engine brake control devices 210 and/or one or more fuel injectors. The control signal may indicate that the one or more exhaust valves are to be in particular positions (e.g., open, partially closed, closed, and/or the like) and that the one or more fuel injectors are to be turned on or off.

For example, in a situation where the engine braking configuration indicates that engine braking is to be applied to a set of four cylinders of the plurality of cylinders 116, the engine brake control module 260 may cause the engine braking to be applied to the four cylinders to increase the temperature of exhaust gas from the engine. To do so, the engine brake control module 260 may cause exhaust valves of the four cylinders to open during compression strokes of the four cylinders. The engine brake control module 260 may further cause fuel injectors associated with the four cylinders to be turned off.

As another example, in a situation where the engine braking configuration indicates that engine braking is to be deactivated (e.g., based on detection of a load increase, and/or the like), the engine brake control module 260 may cause the engine braking to be released from the four cylinders. As a result, the engine brake control module 260 may cause the exhaust valves of the four cylinders to remain closed during the compression strokes and the fuel injectors to be turned back on.

As indicated above, FIG. 2 is provided as an example. Other examples are possible and may differ from what was described in connection with FIG. 2. The number and arrangement of components and/or devices shown in FIG. 2 is provided as an example. In practice, there may be additional components and/or devices, fewer components and/or devices, different components and/or devices, or differently arranged components and/or devices than those shown in FIG. 2. Furthermore, two or more components and/or devices shown in FIG. 2 may be implemented within a single component and/or device, or a single component and/or device shown in FIG. 2 may be implemented as multiple components and/or devices. Additionally, or alternatively, a set of components and/or devices (e.g., one or more components and/or devices) of FIG. 2 may perform one or more functions described as being performed by another set of components and/or devices of FIG. 2.

Figure 3:
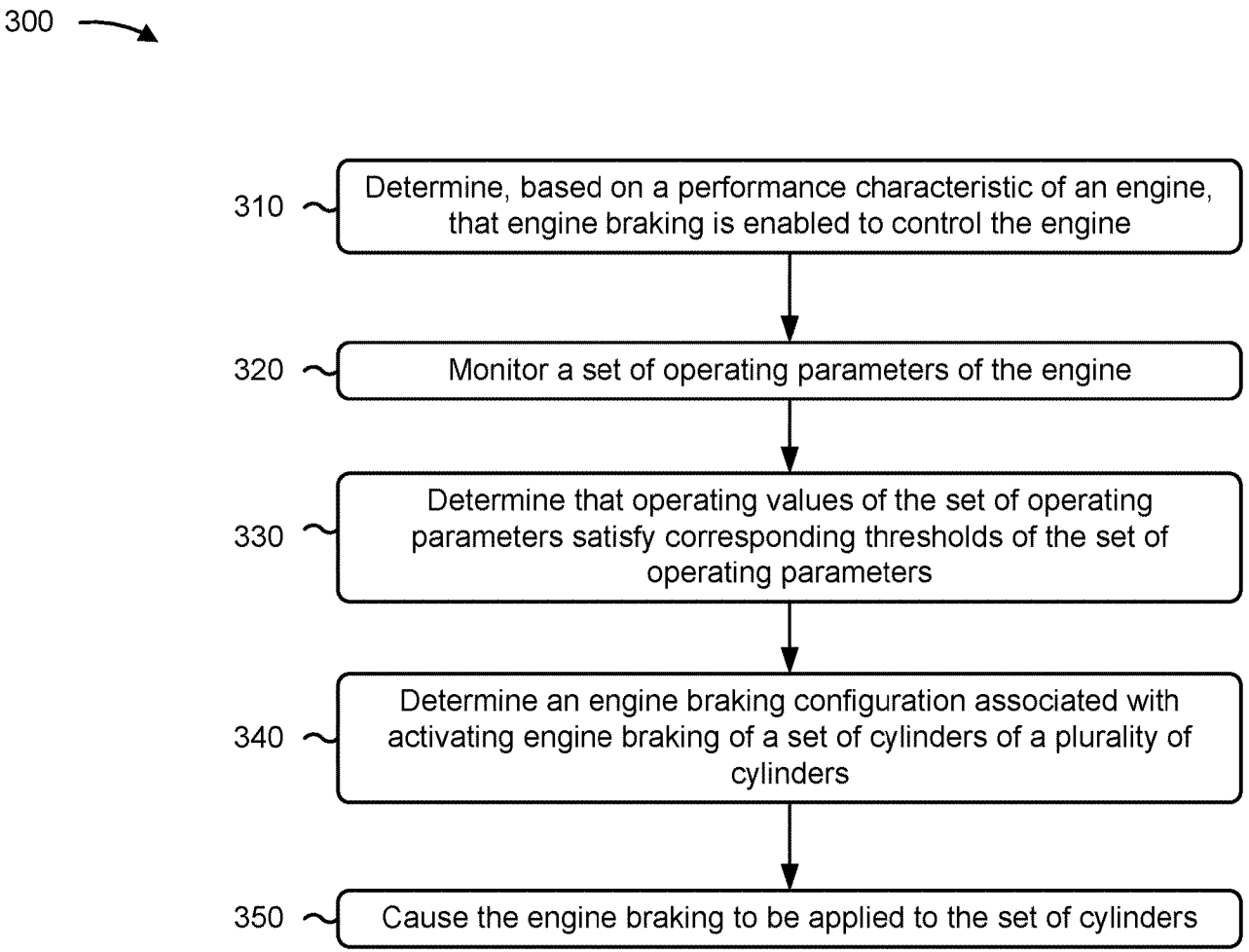
FIG. 3 is a flow chart of an example process relating to engine brake control according to engine operating parameters, as described herein.

FIG. 3 is a flowchart of an example process 300 associated with engine braking for transient response time reduction and/or hydrocarbon reduction. In some implementations, one or more process blocks of FIG. 3 may be performed by a controller (e.g., engine brake controller 230, ECM 104, and/or the like). In some implementations, one or more process blocks of FIG. 3 may be performed by another device or a group of devices separate from or including the controller, such as a sensor (e.g., a sensor of the one or more sensors 106, the one or more sensors 220, and/or the like), and/or the like.

As shown in FIG. 3, the process 300 may include determining, based on a performance characteristic of an engine, that engine braking is enabled to control the engine (block 310). For example, the controller (e.g., using processor 232, memory 234, engine brake enabling module 240, engine brake mapping module 250, engine brake control module 260, and/or the like) may determine, based on the performance characteristic of the engine, that the engine braking is enabled to control the engine. Determining that the engine braking is enabled may be further based on a load of the engine satisfying a low-load threshold.

As further shown in FIG. 3, process 300 may include monitoring a set of operating parameters of the engine (block 320). For example, the controller (e.g., using processor 232, memory 234, engine brake enabling module 240, engine brake mapping module 250, engine brake control module 260, and/or the like) may identify the set of operating parameters of the engine based on the performance characteristic of the engine and/or the engine braking being enabled. Identifying the set of operating parameters may comprise selecting the set of operating parameters from a plurality of operating parameters that are associated with different performance characteristics of the engine. The set of operating parameters may be a first set of operating parameters for the performance characteristic that is different from a second set of operating parameters that is associated with a different performance characteristic. The set of operating parameters may include at least one of an amount of hydrocarbon buildup detected in the exhaust aftertreatment device of the engine, an amount of fuel in a line of the engine, a flow rate of the fuel in the line of the engine, an engine speed of an output of the engine, an air-to-fuel ratio of a turbocharger of the engine, an engine run-time of the engine, an intake manifold pressure of an intake of the engine, or a coolant temperature of the engine.

Monitoring the set of operating parameters may be based on the performance characteristic of the engine. Monitoring the set of operating parameters may comprise identifying a set of sensors that is associated with the set of operating parameters and obtaining the operative values from the set of sensors. Monitoring the set of operating parameters may be via a sensor system of a power system.

As further shown in FIG. 3, process 300 may include determining that operating values of the set of operating parameters satisfy corresponding thresholds of the set of operating parameters (block 330). For example, the controller (e.g., using processor 232, memory 234, engine brake enabling module 240, engine brake mapping module 250, engine brake control module 260, and/or the like) may determine that the operating values of the set of operating values satisfy corresponding thresholds of the set of operating parameters. The set of operating parameters may be associated with applying engine braking to the engine.

As further shown in FIG. 3, process 300 may include determining an engine braking configuration associated with activating engine braking of a set of cylinders of a plurality of cylinders (block 340). For example, the controller (e.g., using processor 232, memory 234, engine brake enabling module 240, engine brake mapping module 250, engine brake control module 260, and/or the like) may determine, based on the operating values, a level of engine braking that is to be applied to the engine, and selecting, based on the level of engine braking, the set of cylinders. Selecting the set of cylinders may comprise determining, based on the level of engine braking, a quantity of cylinders of the engine that are to receive engine braking, and selecting the set of cylinders to include the quantity of cylinders. The engine braking configuration may be associated with activating engine braking of the engine to increase the temperature of exhaust gas from the engine. The set of cylinders may be a proper subset of a total quantity of the cylinders of the engine.

As further shown in FIG. 3, process 300 may include causing the engine braking to be applied to the set of cylinders (block 350). For example, the controller (e.g., using processor 232, memory 234, engine brake enabling module 240, engine brake mapping module 250, engine brake control module 260, and/or the like) may cause valves of the set of cylinders to open during compression strokes of the set of cylinders, and may cause fuel injectors associated with the set of cylinders to be turned off. Process 300 may further include causing an increase of an amount of fuel to be provided to one or more other cylinders, of the engine, that are not included in the set of cylinders.

In some implementations, the process 300 may begin with obtaining the performance characteristic of the engine. The performance characteristic may be associated with at least one of prioritizing a reduction to a transient response time of an output of the engine or prioritizing a reduction of a hydrocarbon buildup in an exhaust aftertreatment device of the engine. Obtaining the performance characteristic may comprise receiving an operator input that identifies the performance characteristic. The operator input may be received via an operator interface that is associated with the engine. Prior to determining that the engine braking is enabled (e.g. block 310), the process 300 may further include determining that the load of the engine satisfies the low-load threshold.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

A control system of the present disclosure is applicable to a machine utilizing a turbocharged power system, such as a watercraft, a motor vehicle, and/or the like. In a low-load state, such a power system may experience poor transient response (e.g., during acceleration, a load increase, and/or the like) due to turbocharger lag and/or sub-standard emissions. Furthermore, even with an aftertreatment device to reduce certain types of emissions, insufficient temperature of exhaust gases may lead to hydrocarbon buildup.

To reduce transient response time and/or hydrocarbon buildup, the control system of the present disclosure selectively activates engine braking in a proper subset of cylinders to increase the temperature of the exhaust gases. By doing so, the control system increases a rotational speed of the turbocharger and, as a result, boosts power levels. Furthermore, the increase of the temperature prevents buildup of unburnt hydrocarbons in the aftertreatment device. Because the control system includes the one or more sensors 220, which measure engine run-time, an amount of fuel, a flow rate of the fuel, an intake manifold pressure, an engine speed, coolant temperature, hydrocarbon buildup, air-to-fuel ratio, and/or the like, the control system is able to more quickly detect and resolve issues relating to transient response and/or hydrocarbon buildup.

The foregoing disclosure provides illustration and description but is not intended to be exhaustive or to limit the implementations to the precise form disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, satisfying a threshold may, depending on the context, refer to a value being greater than the threshold, greater than or equal to the threshold, less than the threshold, less than or equal to the threshold, equal to the threshold, etc., depending on the context.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A method, comprising:

obtaining a performance characteristic of an engine;

wherein the performance characteristic is associated with prioritizing between:

a reduction in a transient response time of an output of the engine, and a reduction in a hydrocarbon buildup in an exhaust aftertreatment device of the engine;

identifying, based on the performance characteristic, a set of operating parameters of the engine that are associated with the performance characteristic, wherein the set of operating parameters differ based on the performance characteristic, when the performance characteristic is associated with prioritizing the reduction in the transient response time of the output of the engine, the set of operating parameters include at least one of:

an engine run time of the engine, an intake manifold pressure of an intake of the engine, or a coolant temperature of the engine, and when the performance characteristic is associated with prioritizing the reduction in the hydrocarbon buildup in the exhaust aftertreatment device of the engine, the set of operating parameters include at least one of:

an amount of the hydrocarbon buildup in the exhaust aftertreatment device of the engine, or an air-to-fuel ratio of a turbocharger of the engine;

monitoring the set of operating parameters to obtain operating values;

determining that the operating values satisfy corresponding thresholds of the set of operating parameters;

determining, based on the operating values satisfying the corresponding thresholds, an engine braking configuration associated with activating engine braking of a set of cylinders of the engine to increase a temperature of exhaust gas from the engine, wherein the set of cylinders is a proper subset of a total quantity of cylinders of the engine; and causing the engine braking to be applied to the set of cylinders to increase the temperature of the exhaust gas from the engine.

2. The method of claim 1, wherein obtaining the performance characteristic comprises:

receiving an operator input that identifies the performance characteristic, wherein the operator input is received via an operator interface that is associated with the engine.

3. The method of claim 1, wherein identifying the set of operating parameters comprises:

selecting the set of operating parameters from a plurality of sets of operating parameters that are associated with different performance characteristics of the engine, wherein the different performance characteristics include the performance characteristic.

4. The method of claim 1, wherein determining the engine braking configuration comprises:

determining, based on the operating values, a level of engine braking that is to be applied to the engine; and selecting, based on the level of engine braking, the set of cylinders.

5. The method of claim 4, wherein selecting the set of cylinders comprises:

determining, based on the level of engine braking, a quantity of cylinders of the engine that are to receive engine braking; and selecting the set of cylinders to include the quantity of cylinders.

6. The method of claim 1, wherein causing the engine braking comprises:

causing valves of the set of cylinders to open during compression strokes of the set of cylinders; and causing fuel injectors associated with the set of cylinders to be turned off.

7. The method of claim 1, wherein the set of operating parameters further include at least one of:

an amount of fuel in a line of the engine, a flow rate of the fuel in the line of the engine, or an engine speed of an output of the engine.

8. A control system, comprising:

a plurality of sensors; and a controller communicatively coupled to the plurality of sensors to:

determine that engine braking is enabled to control an engine;

identify, based on the engine braking being enabled, a set of operating parameters of the engine, wherein the set of operating parameters differ based on a performance characteristic, wherein the performance characteristic is associated with prioritizing between:

a reduction in a transient response time of an output of the engine, and a reduction in a hydrocarbon buildup in an exhaust aftertreatment device of the engine, when the performance characteristic is associated with prioritizing the reduction in the transient response time of the output of the engine, the set of operating parameters include at least one of:

an engine run time of the engine, an intake manifold pressure of an intake of the engine, or a coolant temperature of the engine, and when the performance characteristic is associated with prioritizing the reduction in the hydrocarbon buildup in the exhaust aftertreatment device of the engine, the set of operating parameters include at least one of:

an amount of the hydrocarbon buildup in the exhaust aftertreatment device of the engine, or an air-to-fuel ratio of a turbocharger of the engine;

monitor, via the plurality of sensors, the set of operating parameters of the engine;

determine that operating values of the set of operating parameters satisfy corresponding thresholds of the set of operating parameters that are associated with applying engine braking to the engine;

determine, based on the operating values satisfying the corresponding thresholds, an engine braking configuration associated with activating engine braking of a set of cylinders of the engine; and cause the engine braking to be applied to the set of cylinders to increase a temperature of exhaust gas from the engine.

9. The control system of claim 8, wherein the controller, when determining that the engine braking is enabled, is configured to:

determine that the engine braking is enabled based on a load of the engine satisfying a low-load threshold and the performance characteristic.

10. The control system of claim 8, wherein the controller, when monitoring the set of operating parameters, is configured to:

obtain the operating values from plurality of sensors.

11. The control system of claim 8, wherein the performance characteristic is associated with prioritizing the reduction in the hydrocarbon buildup in the exhaust aftertreatment device of the engine, and wherein the set of operating parameters further includes at least one of:

an amount of fuel in a line of the engine, a flow rate of the fuel in the line of the engine, or an engine speed of an output of the engine.

12. The control system of claim 8, wherein the controller, when determining the engine braking configuration, is configured to:

determine, based on the operating values, a quantity of cylinders of the set of cylinders that are to receive engine braking.

13. The control system of claim 8, wherein the controller is configured to:

cause an increase of an amount of fuel associated with fuel injection to be provided to one or more other cylinders, of the engine, that are not included in the set of cylinders.

14. The control system of claim 8, wherein the controller is further configured to:

receive an operator input that identifies the performance characteristic, wherein the operator input is received via an operator interface that is associated with the engine.

15. A power system, comprising:

an engine that includes a plurality of cylinders;

a plurality of sensors; and a controller configured to:

determine, based on a performance characteristic of the engine, that engine braking is enabled to control the engine, wherein the performance characteristic is associated with prioritizing between:

a reduction in a transient response time of an output of the engine, and a reduction in a hydrocarbon buildup in an exhaust aftertreatment device of the engine;

identify, based on the engine braking being enabled, a set of operating parameters of the engine that are associated with the performance characteristic, wherein the set of operating parameters differ based on the performance characteristic, when the performance characteristic is associated with prioritizing the reduction in the transient response time of the output of the engine, the set of operating parameters include at least one of:

an engine run time of the engine, an intake manifold pressure of an intake of the engine, or a coolant temperature of the engine, and when the performance characteristic is associated with prioritizing the reduction in the hydrocarbon buildup in the exhaust aftertreatment device of the engine, the set of operating parameters include at least one of:

an amount of the hydrocarbon buildup in the exhaust aftertreatment device of the engine, or an air-to-fuel ratio of a turbocharger of the engine;

monitor, via the plurality of sensors, the set of operating parameters;

determine that operating values of the set of operating parameters satisfy corresponding thresholds of the set of operating parameters;

determine, based on the operating values, an engine braking configuration associated with activating engine braking of a set of cylinders of the plurality of cylinders; and cause the engine braking to be applied to the set of cylinders to cause an increase of an amount of fuel to be provided to one or more other cylinders that are not included in the set of cylinders.

16. The power system of claim 15, wherein the controller, when determining that the engine braking is enabled, is configured to:

determine that the engine braking is enabled based on a load of the engine satisfying a low-load threshold and the performance characteristic.

17. The power system of claim 15, wherein the performance characteristic is associated with prioritizing the reduction in the transient response time of the output of the engine, and wherein the set of operating parameters further include at least one of:

an amount of fuel in a line of the engine, a flow rate of the fuel in the line of the engine, or an engine speed of an output of the engine.

18. The power system of claim 15, wherein the controller, when determining the engine braking configuration, is configured to:

determine, based on the operating values, a level of engine braking that is to be applied to the engine;

determine, based on the level of engine braking, a quantity of cylinders of the engine that are to receive engine braking; and select the set of cylinders to include the quantity of cylinders.

19. The power system of claim 15, wherein the controller is configured to:

prevent, while the engine braking is being applied to the set of cylinders, fuel from being injected into the set of cylinders.

20. The power system of claim 15, wherein the controller is further configured to:

receive an operator input that identifies the performance characteristic, wherein the operator input is received via an operator interface that is associated with the engine.

* * * * *